US005168681A

United States Patent [19]

Ayrapetyan

[11] Patent Number: 5,168,681

[45] Date of Patent: Dec. 8, 1992

[54] PRESTRESSED WOOD FLOOR SYSTEM

[75] Inventor: Ruben Ayrapetyan, Whittier, Calif.

[73] Assignee: Horsel PLC, Morley, United Kingdom

[21] Appl. No.: 569,881

[22] Filed: Aug. 20, 1990

[51] Int. Cl.[5] ..... E04C 3/26

[52] U.S. Cl. ..... 52/223 L; 52/223 R; 52/227; 52/228; 52/291; 52/723

[58] Field of Search ..... 52/223 R, 223 L, 227, 52/177, 228, 291, 660, 723, 229, 299, 695

[56] References Cited

U.S. PATENT DOCUMENTS

| | | | |
|---|---|---|---|
| 1,339,601 | 5/1920 | Maehler | 52/291 |
| 2,837,776 | 6/1958 | Klein | 52/223 R |
| 3,686,809 | 8/1972 | Lindal . | |
| 4,038,803 | 8/1977 | Schoeller | 52/291 X |
| 4,041,664 | 8/1977 | Davis, Jr. . | |
| 4,145,854 | 3/1979 | Rodahl et al. . | |
| 4,221,098 | 9/1980 | Mayer et al. . | |
| 4,275,537 | 6/1981 | Pinson . | |
| 4,366,655 | 1/1983 | Mayer et al. . | |
| 4,402,948 | 2/1987 | Travis . | |
| 4,812,096 | 3/1989 | Peterson | 52/227 X |

FOREIGN PATENT DOCUMENTS

| | | | |
|---|---|---|---|
| 296404 | 2/1917 | Fed. Rep. of Germany | 52/291 |
| 810177 | 3/1937 | France | 52/291 |

OTHER PUBLICATIONS

"Response of Nailed Wood-Joist Floors to Static Loads," by Anton Polensek, George H. Atherton, Stanley E. Corder, and Jack L. Jenkins, Forest Products Journal, vol. 22, Sep. 1972.

"Wood Floor Behavior: Experimental Study" by Ricardo O. Foschi, Journal of Structural Engineering, vol. 111, No. 11, Nov. 1985.

"Some Performance Characteristics of Wood Joist Floor Panels" by Stanley E. Corder and David E. Jordan, Forest Products Journal, vol. 25, No. 2, Feb. 1975.

"Static and Dynamic Properties of Glued Wood-Joist Floors" by Anton Polensek, Forest Products Journal, vol. 21, No. 12, Sep. 1971.

*Primary Examiner*—David A. Scherbel
*Assistant Examiner*—Robert Canfield
*Attorney, Agent, or Firm*—Merchant, Gould, Smith Edell, Welter & Schmidt

[57] ABSTRACT

A prestress floor system for wood floor framing structures places the structure's joists under a laterally directed compressive force while the joists are maintained in their relative positions by blocking elements. The compressive force is provided by a cable anchored at one end to an outermost joist and anchored at the other to a spring that is, in turn, anchored to an outermost joist. The resulting structure has increased vertical stiffness and reduces the amount of deflection, vibration, and noise experienced during loading.

19 Claims, 4 Drawing Sheets

PRESTRESSED WOOD FLOOR SYSTEM

BACKGROUND OF THE INVENTION

1. Field of the Invention

This invention relates generally to building structures and, more particularly, to load carrying wood frames for supporting floors, ceilings, and the like.

2. Description of the Related Art

Wood structures predominate in residential and light commercial construction. In the case of wood floor framing, the structure typically comprises a series of parallel, spaced-apart wooden spanning members or joists. These joists can be provided in a number of sizes, such as those known in the United States as two-by-twelves, which have standard dimensions of one and one-half inches thick by eleven and one-fourth inches high, and are allowed by most building codes in the United States to have a length of slightly over 21 feet. A range of other sizes is available, including joists known as two-by-eight up through two-by-fourteen. When the span length exceeds 16 feet, vibration and vertical deflection upon loading can become quite noticeable. Even floor systems that are properly constructed and structurally safe can exhibit much movement and resulting noise, which can be quite disconcerting and psychologically troublesome for any occupants.

In the United States, the wood joists are typically installed at a 16-inch spacing, and therefore a typical 20-foot by 20-foot room will require fifteen to sixteen joists. Large 4-foot by 8-foot sheets of plywood are attached to the upper surface of the joists using nails driven through the sheets into the joists, thereby forming the floor subsurface to which flooring, tile, or carpeting can be laid. Blocking, or smaller wood segments that span the distance between joists, is installed below the seams of adjacent plywood sheets to provide a nailing surface.

Loading of the floor, such as when a person walks on the floor, causes vertical deflection and resultant noise and vibration. This occurs because, with 16-inch joist spacing, substantially all of the load is supported by a single joist, which cannot support the pressure sufficiently to eliminate the deflection. Conventionally, the extra vertical stiffness required to stop the deflection is provided by doubling the number of joists, or using an 8-inch joist spacing. This doubles the number of joists needed and therefore doubles the joist costs and dramatically increases the amount of time required for construction.

Even if not present initially, the vibration and vertical deflection upon loading can spontaneously occur, or become worse, with age. This occurs because lumber initially has approximately a 19% moisture content when the structure is erected, and later dries out and stabilizes at approximately a 9% moisture content, thereby shrinking the wood. This can change the relative dimensions of the structure, even pulling against the nails used to erect the structure, causing open spaces to appear and pull the members apart. Thus, when the floors are subject to loading, as when someone walks over them, the members are moved relative to each other, causing vertical deflection and vibration, and often squeaking as well.

Methods other than doubling the number of joists can be used to control the vertical deflection and squeaking of floor systems. Constructing smaller spaces, such as by using joist spans having a length that is less than the maximum allowed by building codes, decreases the amount of vertical deflection. Often, however, this conflicts with the architectural design for the completed structure. If the original span length is to be kept, designers can choose alternate construction materials, such as truss joists, steel beams, and concrete slabs. Unfortunately, these materials are much more costly than comparable wood floor systems.

From the foregoing, it should be apparent that there is a need for a wood floor system that provides reduced vertical deflection upon load and controls vibration and squeaking, that allows for shrinkage of the wood floor structure members, and does so without the high cost and complex assembly of floor systems constructed from materials other than wood. The present invention meets these needs.

SUMMARY OF THE INVENTION

The present invention provides a building structure comprising a prestressed floor system in which the joists are prestressed by a combination of pressing elements that exert a laterally directed force pressing the joists toward each other and spacing elements that oppose the force and keep the joists in their relative positions. This couples the joists together such that substantially more than one joist supports a point load, such as a person walking on the floor. That is, all of the joists contribute to supporting the load, and it has been found that three to five of the joists might actually experience some minimally observable deflection as a load is applied. The pressing elements are advantageously inexpensive and simple to manufacture, and the spacing elements are preferably readily available at job sites. The pressing elements and spacing elements are easily installed, and provide a prestressed floor system with increased vertical stiffness and reduced deflection, vibration, and squeaking under loading, at much cheaper cost than alternative materials or double joists. The spacing elements can advantageously comprise blocking placed between adjacent joists, spanning the distance from one joist to the next. The pressing elements can advantageously comprise a cable with attachments at two outside joists, passing through a hole in each of the remaining joists, thereby pressing the joists toward each other and placing them under compression.

In particular, the spacing elements can comprise blocking cut from the same material as the joists, and the pressing elements can advantageously comprise a cable and spring arrangement, in which a spring is attached at one end to an outside joist while the cable is attached to an opposite outside joist and then is passed through a hole in each of the remaining joists in a straight line, to be attached to the free end of the spring. Once the spring and cable are attached the spring is stretched, and therefore the cable is placed under tension. The force of the spring is transmitted through the spacing elements across all the joists in the structure, placing them under compression. The spring force is selected such that, as the wood dries and shrinks, the cable is kept taut and the spacing elements are kept in position between the joists.

Most building codes and regulations allow holes of up to one-inch diameter in wood joists, for plumbing and electrical connections. The holes necessary for the cable can be of much less than one-inch diameter, and therefore the integrity of the joist is not compromised. The joists experience zero stress and zero shear forces along the neutral axis at the joist vertical and longitudinal midpoint. Therefore, the holes in the joists through which the tension cable is passed are advantageously located at each joist midpoint. Placing the hole for the cable at the midpoint has no effect on the strength of the joist, and is preferred.

The spacing elements can be advantageously arranged in two parallel rows, straddling the cable. This provides the necessary increased stiffness and lateral rigidity without localized bending of the joists when the cable places them under compression. The spacing between the rows of blocking is dictated by the spring force used and the working area between the joists. The spring transmits its force to the joists and blocking elements through a pressure plate, to which the spring is attached. The size of the plate determines the spacing between the blocking elements, and is determined by calculating the crushing capacity of the blocking elements. In particular, the crushing capacity of the wood must be greater than the actual stress applied. The crushing capacity of wood that is typically used in wood frame building structures is 650 lbs. per square inch. It should be appreciated that, while the spring force is necessary for placing the floor structure in a prestress condition, it is not necessary for support of the structure. That is, if either the spring or cable were to break, the remaining wood floor structure would still stand. This is in contrast to many concrete structures, for example, in which prestress is necessary for the structure to remain erect.

Materials other than standard wood lumber can be used to create a building structure in accordance with the present invention. For example, the joists can be manufactured having a plywood laminate construction, such as the joists made by Truss Joist, Inc., typically known as "TJI Joists." Such joists comprise elongated laminate members separated by a relatively thin plywood web, thereby creating a cross-sectional shape similar to that of an I-beam. Alternatively, the web can be of an open web design, in which the laminate members are separated by diagonal cross-members, or girders. Because TJI joists are of a laminated construction, they are much stiffer, and can be made much larger, than conventional wood joists. Thus, TJI joists can be made longer than standard wood joists, and the structures that can be erected using the present invention in this way can be quite large.

The present invention provides a prestress wood floor system that is easily constructed at nominal cost when compared to conventional wood floor framing. Spring forces and cable lengths can be standardized for room sizes, and cables can be cut to length at a job site. The resulting floor structure has increased vertical rigidity and reduces squeaking. In addition, the structure has the added benefit of increased lateral stiffness. The floor is maintained under a prestress condition even as the wood dries and shrinks, because the spring force takes up any slackness in the cable.

Other features and advantages of the present invention should be apparent from the following description of the preferred embodiment, which illustrates by way of example, the principles of the invention.

DESCRIPTION OF THE PREFERRED EMBODIMENT

The following description of the present invention is not to be taken in a limiting sense, but is made merely for the purpose of illustrating the general principles of the invention. The following detailed description is of the best presently contemplated modes of carrying out the present invention.

Figure 1:
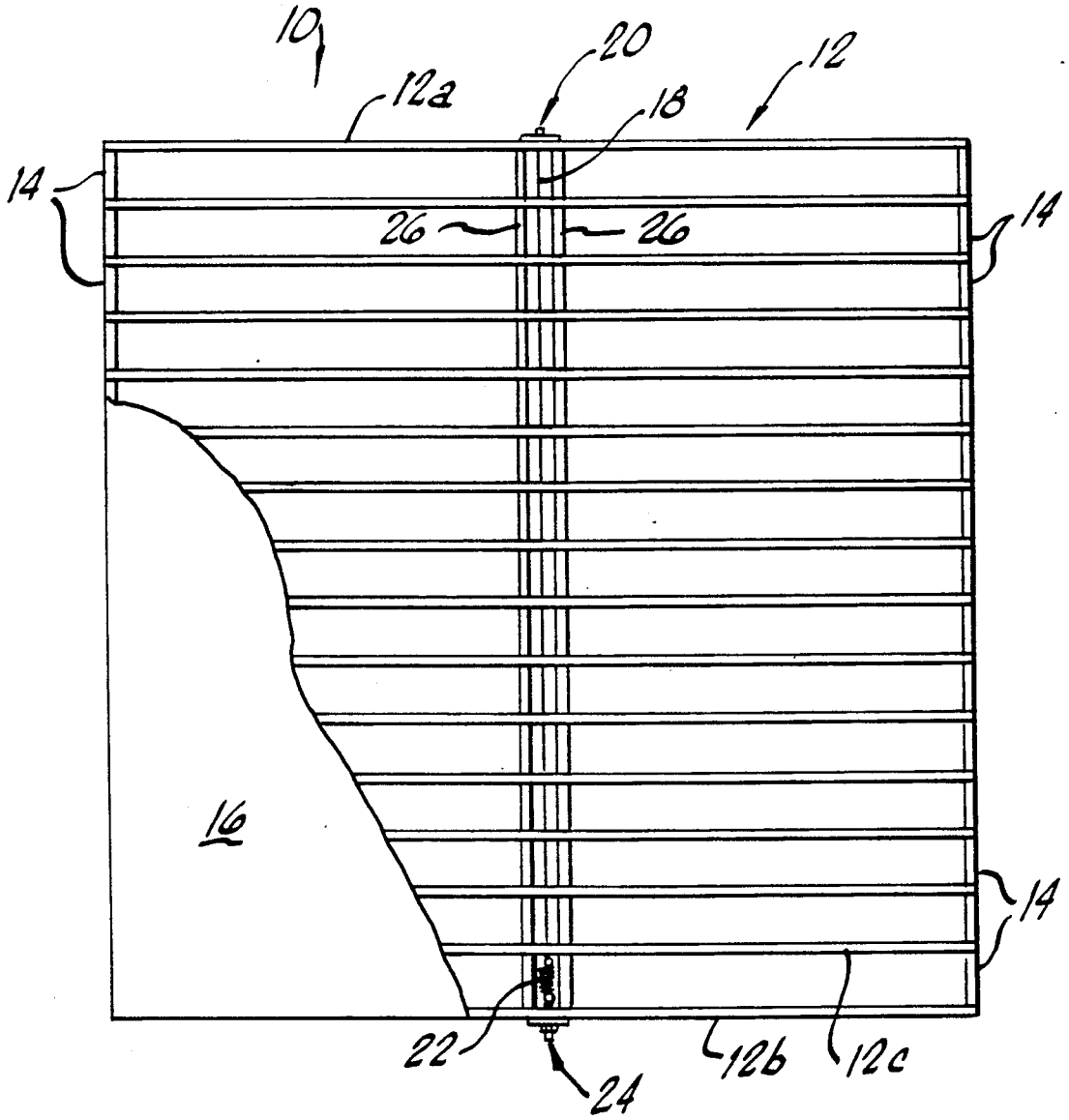
FIG. 1 is a plan view of a floor system constructed in accordance with the present invention.

A prestressed wood floor system 10 is illustrated in FIG. 1 and comprises a plurality of elongated, parallel joists 12 spaced apart laterally from each other. The joists are illustrated in plan view and can be any one of several materials, from standard wood joists in a variety of sizes, including what are known as two-by-twelves (actually 1½ inches by 11¼ inches), to joists having a composite, laminate construction comprising elongated spans joined by a web, which can be laminate or open web. In FIG. 1, the free ends of the joists are attached to cross-wise spans or blocking elements 14 often simply referred to as blocking. These elements create a floor frame to which a plurality of plywood sheets are attached, thereby forming a floor surface 16. When a load is placed on the floor, such as when a person walks across it, a certain amount of vertical deflection will typically occur as the joist beneath the person attempts to support the load. In accordance with the present invention, the floor system is placed under a prestress condition to distribute the load across three to five joists or more and to thereby minimize vertical deflection.

The prestress is achieved with a cable 18 that is passed through each joist at its midpoint, and is used to apply a compression force transmitted through all the joists. The cable 18 is approximately ¼ inch diameter. Holes of up to one-inch diameter are allowed by most building codes and regulations, for plumbing and electrical connections, and will not compromise the strength of a joist. Even so, the holes necessary for the ¼ inch cable can be of much less than one-inch diameter, for example ⅜ inch, and therefore the joist need not be weakened. Furthermore, the joists experience zero stress and zero shear forces along the neutral axis at the joist vertical and longitudinal midpoint. Therefore, the holes in the joists through which the cable is passed are advantageously located at each joist midpoint. Placing the hole for the cable at the midpoint has no effect on the strength of the joist.

The cable 18 is anchored at one end to a first one of the outside joists **12*a* by a stud 20 and is attached at the opposite end to a spring 22, which is attached to a second outside joist 12*b* by a stud 24. The stud can be adjusted to stretch the spring, placing the cable under varying amounts of tension. A blocking element 26 is located so as to bridge the space between each pair of adjacent joists and couple the force from the cable through the joists. The blocking elements are arranged into two parallel rows that straddle the cable 18. The blocking elements 26** oppose the force of the spring and cable, and therefore are placed under compression.

The combination of the blocking 26, the cable 18, and spring 22 place the joists 12 in a state of equilibrium in which the joists will substantially maintain the relative spacing between each other, and will minimize the amount of vertical deflection they experience while being subjected to a load. The combination has been found to reduce vertical deflection for a given load by as much as 50% when compared with conventional wood floor systems. The additional cost for a typical 20-foot by 20-foot room is expected to be almost one-tenth the additional cost for doubling the number of joists, which would be the conventional way of obtaining similar results. As an added benefit, the structure in accordance with the present invention has increased lateral stiffness.

Figure 2:
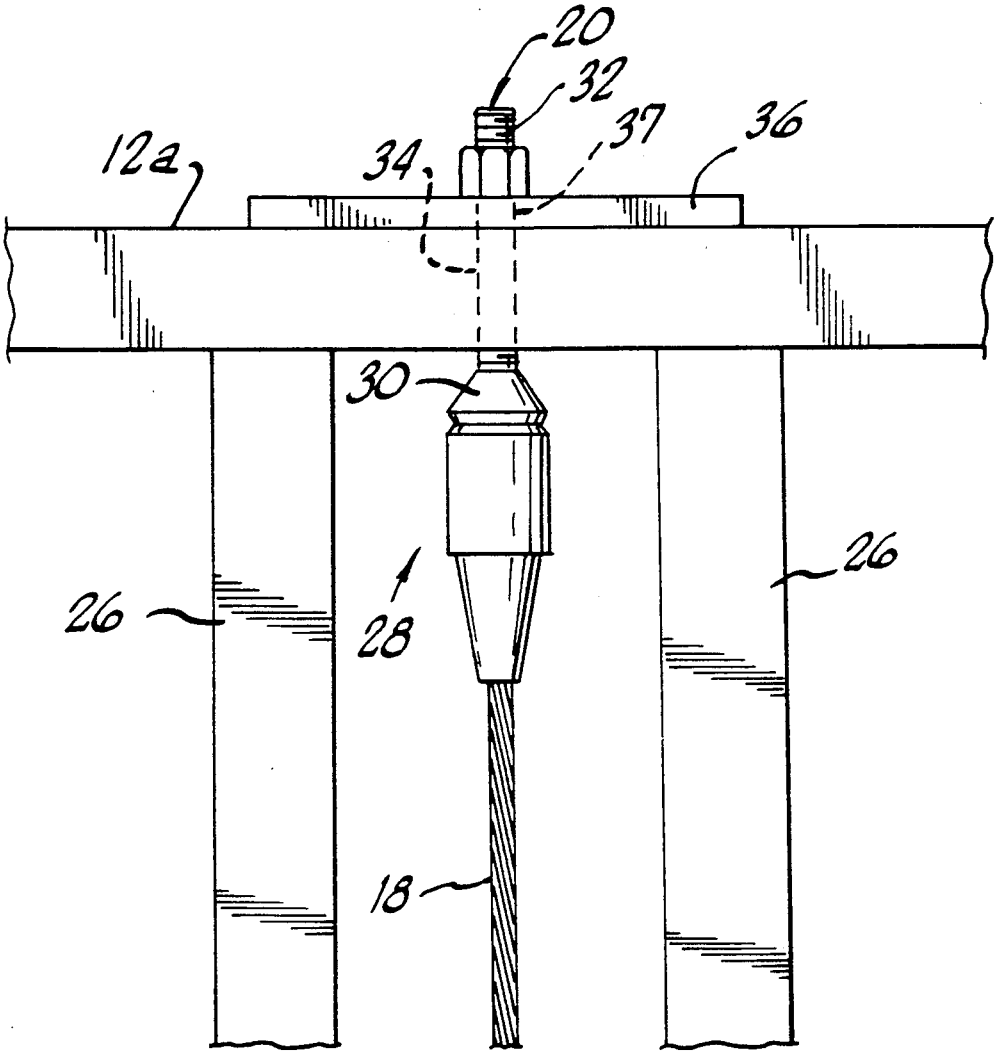
FIG. 2 is a detail plan view of the floor system illustrated in FIG. 1, showing the attachment of the cable to a joist.

The attachment of the cable 18 to the first outside joist 12*a* is shown in greater detail in FIG. 2. The end of the cable is attached to a stud 20 comprising a stud terminal body 28, a locking cone 30, and a threaded stud bolt 32. During assembly of the structure 10 at the job site, the cable 18 is inserted into the tapered end of the terminal body and into engagement with the cone 30. The stud bolt 32 extends from the tapered end of the cone and is inserted through a hole 34 in the joist. A steel plate 36 is placed against the outside surface of the joist and the stud bolt is passed through a hole 37 in the plate. A fastening nut 38 is threaded onto the bolt and fixes the stud bolt in position, gripping the cable more tightly as the nut is turned and tightened toward the cone 30, thereby placing the cable 18 under tension as described further below.

The stud 20 is readily available and, for example, comprises an "EASY-RIG" stud terminal, Model Number ER7-8 obtainable from MacWhyte Marine Products. The cable also is readily available, and preferably comprises a ¼ inch outside diameter stranded steel cable. The steel plate 36 is preferably ⅜ inches thick and is 6-inches by 6-inches square. The size of the plate and the spacing between the blocking elements 26 is determined by the crushing capacity of the wood, as described further below.

Figure 3:
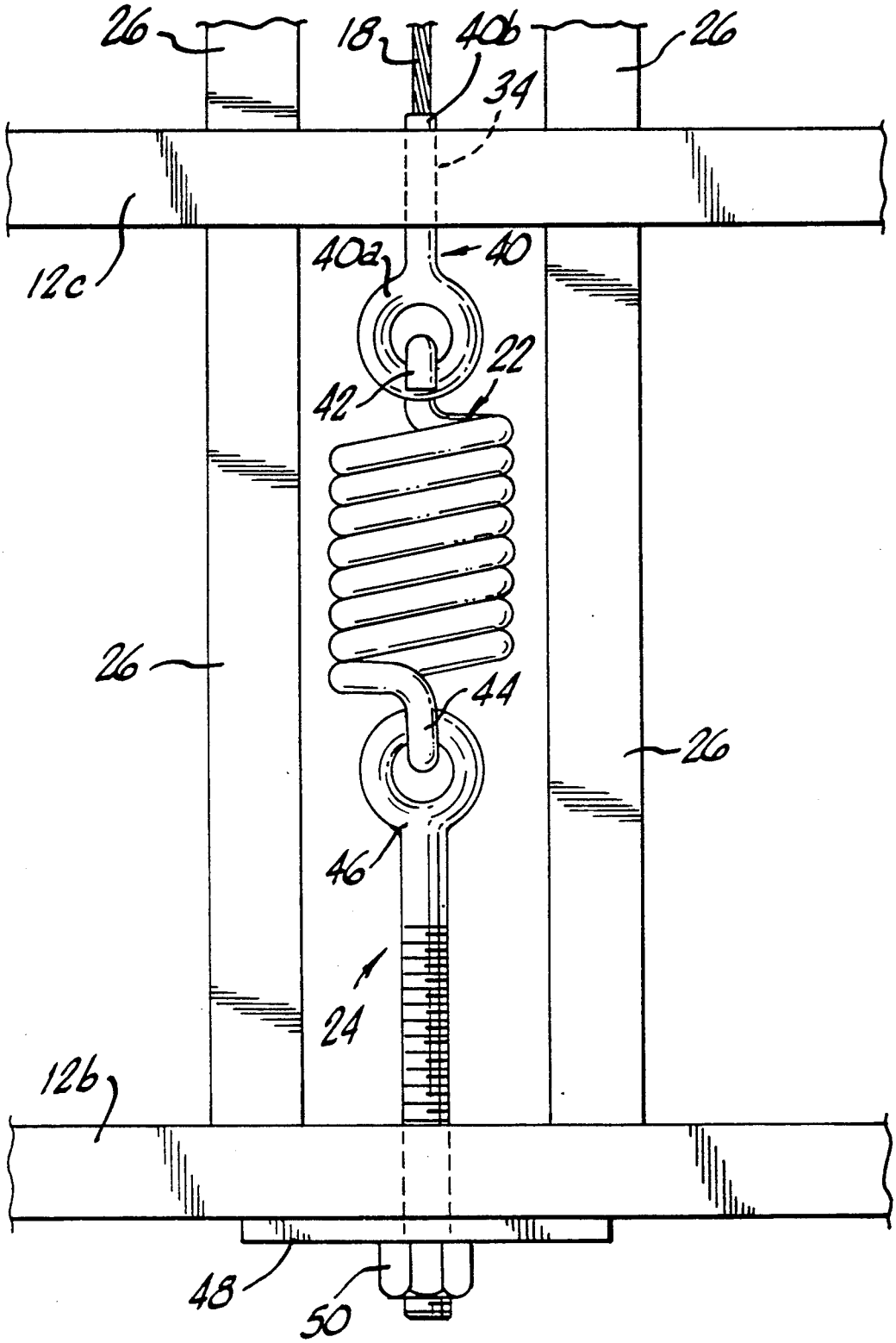
FIG. 3 is a detail plan view of the floor system illustrated in FIG. 1, showing the attachment of the spring and cable to a joist.

The attachment of the cable 18 to the spring 22, and of the spring to the second outside joist 12*b*, is illustrated in greater detail in FIG. 3. Prior to delivery at a job site, the cable is swaged into a large ring eye 40 having an eyelet 40*a* and a shank 40*b* that is passed through the midpoint of the joist 12*c* that is adjacent the second outermost joist 12*b*. By swaging the cable the ring eye 40 prior to delivery and use of the cable, there is no need for field swaging at the job site. This simplifies the construction process. A first hooked end 42 of the spring 22 is passed through the eyelet of the ring eye 40. The opposite end of the spring has a second hook 44, which is passed through the eyelet 46 of the stud bolt 24. The threaded shank 47 of the stud bolt is passed through the outermost joist 12*b* and a steel plate 48, and is secured by a nut 50. Tightening the nut draws the eyelet 46 of the stud bolt toward the nut. Because the cable 18 is securely tightened at its opposite end to the first outermost joist 12*a* by the stud 20, tightening the nut 50 stretches the spring 22 and pulls against the cable, placing the cable under tension. The tension on the cable can be calibrated to a fixed amount of spring stretching, such as by measuring the eyelet-to-eyelet distance or the coil-to-coil distance. In this way, the cable tension can be adjusted to a predetermined amount.

As noted, the spacing between the blocking elements 26 and the size of the steel plates 36 and 48 are determined by the crushing capacity of the lumber used to construct the structure. In practice, the lumber typically used in wood frame construction has a crushing capacity of 650 pounds per square inch. For the loads that will be endured by the floor structure 10, it should typically be designed to accommodate a 2500 lb. load. The crushing capacity must be greater than the actual stress applied to the wood, and therefore the spring force in pounds divided by the blocking element area covered by the steel plates must be less than 650 pounds per square inch. For example, for a crushing capacity of 650 lbs. per square inch, and a 2500 lb. load, a steel plate acting on the blocking elements 26 over an area of six square inches would provide 3900 lbs. of stress that can be accommodated. This is greater than the actual load, and comfortably exceeds the maximum margin of safety typically required by building codes in the United States.

Figure 4:
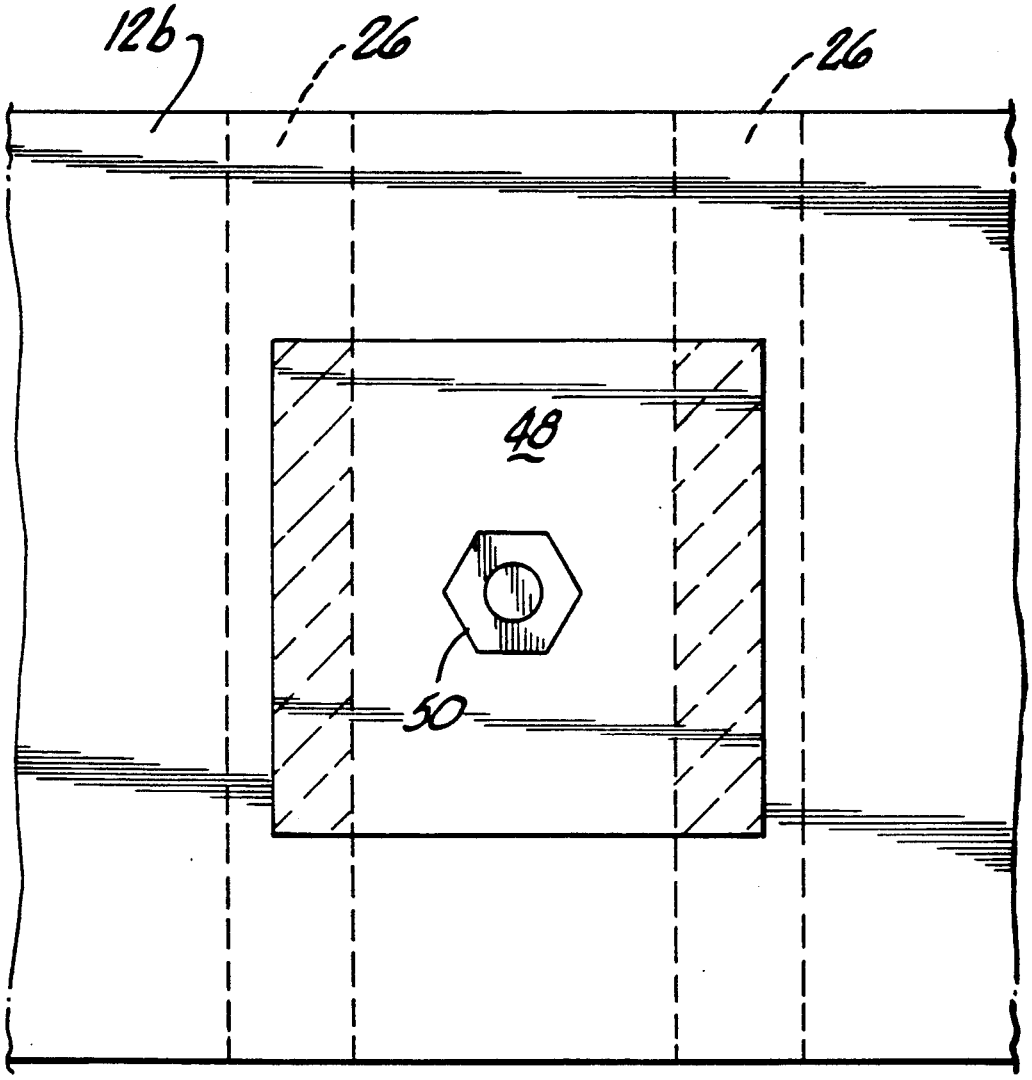
FIG. 4 is a cross-sectional view of the cable attachment through a wood joist.

The steel plates 36 and 48 can conveniently provide six square inches of coverage for the blocking 26 by covering a one-inch by six-inch area along the joist. FIG. 4 most clearly shows the relative spacing between the blocking and the coverage of the blocking through a joist by one of the steel plates 48. The area of the steel plate that overlaps the blocking elements 26, represented by dotted lines in cross-section, is an area one-inch wide and six-inches tall indicated by the cross-hatching. Because the square plate is six-inches by six-inches, and the plate covers one inch of each blocking element, a four inch face-to-face spacing between the blocking elements is indicated. The steel plate size and area of overlap were experimentally determined to be sufficient to achieve the desired results with a safety margin.

When a wood floor structure is first erected, the lumber has a moisture content of approximately 19%. As the lumber ages, it gradually decreases in moisture to stabilize at a moisture content of approximately 9%. Thus, a joist having a length of 20 feet will shrink approximately ⅝ inches. It is this shrinkage that is partially responsible for the vertical deflection, vibration, and noise under load that is often exhibited by wooden structures. The shrinkage changes the relative position of the joists and subfloor sheets, pulling against the nails that hold the elements together and creating gaps that can close when subjected to a load. This closing causes vertical deflection, vibration, and squeaking.

The spring 22 effectively controls the effects of shrinkage, and keeps the cable 18 taut under tension because the spring force is selected to compensate for the shrinkage. As the wood shrinks, the spring 22 will be stretched less and therefore the spring force will decrease. For example, where a spring force of 2500 lbs. is desired, the spring should be stretched initially so as to provide a spring force of approximately 3500 lbs. After the wood has reached its stable moisture content, the wood will have shrunk and the spring will have been stretched less to exhibit the desired spring force of 2500 lbs. Where laminate construction joists are used, the spring forces will likely be higher. The higher spring force is necessary because laminate joists are typically of longer spans than wood joists, and therefore must support a greater weight. The potential for vertical deflection upon load will be greater, and therefore a greater compressive force acting on the joists is necessary to prevent deflection.

The present invention provides a wood frame structure that has been found to reduce vertical deflection by half when compared with conventional wood frame floor structures. To achieve an equal stiffness with conventional flooring, it would be necessary to double the number of joists, significantly increasing the cost of a typical 20-foot by 20-foot room. In accordance with the present invention, a compressive force is applied to the joists, and the distribution of load is increased from one joist to three to five joists or more. That is, all of the joists assist in supporting the load through the cable and blocking. The cable used to apply the compressive force can be provided in standard lengths, with the cable being cut at a job site to suit the particular dimensions of a given structure. Resistance to the compressive force can be provided by blocking elements that are created from the same materials used for the joists, and that therefore are readily available at the job site. The cable tension can be provided by a spring, which allows the structure to adjust itself so that the compression force applied will reach the desired level after the wood has reached its final moisture content.

The present invention has been described above in terms of presently preferred embodiments so that an understanding of the present invention can be conveyed. There are, however, many configurations for wood floor systems not specifically described herein, but with which the present invention is applicable. For example, additional mechanisms for applying cable tension might occur to those skilled in the art. The present invention should therefore not be seen as limited to the particular embodiments described herein, but rather it should be understood that the present invention has wide applicability with respect to wood floor systems and frame structures. Such other configurations may be achieved by those skilled in the art in view of the description herein.

I claim:

1. A load carrying structure, for supporting vertical loads, comprising:

a plurality of substantially parallel spaced-apart joists positioned between a first joist and a last joist that support sheets comprising a ceiling or floor;

spacing means for maintaining the lateral spacing of the joists while they are under laterally directed forces; and pressing means for pressing the joists laterally toward each other under a predetermined force transmitted through the spacing means and for reducing vertical deflection while the joists are under load.

2. A load carrying structure as recited in claim 1, wherein the spacing means comprises a plurality of blocking elements located between adjacent joists.

3. A load carrying structure as recited in claim 2, wherein the pressing means comprises a spring anchored to the first joist and a cable anchored to the last joist at one end and to the spring at its other end.

4. A load carrying structure as recited in claim 1, wherein the pressing means comprises a spring anchored to the first joist and a cable anchored to the last joist at one end and to the spring at the other end.

5. A load carrying structure as in claim 1, wherein the pressing means comprises:

a cable coupling the first joist with the last joist; and tensioning means for maintaining the cable under tension.

6. a load carrying structure as recited in claim 5, wherein the tensioning means includes adjustable anchoring means for coupling the cable to one of the first and the last joists and for providing adjustable amounts of tension thereto.

7. A load carrying structure as recited in claim 5, wherein the tensioning means comprises:

a spring coupling the cable and the last joist; and a bolt coupled to the spring and anchoring the spring to the last joist, the bolt passing through the last joist through an aperture and adjustably fastened by a nut to an opposite side of the joist so as to permit adjustment of the tension on the spring.

8. A load carrying structure for supporting vertical loads, comprising:

a plurality of spaced-apart longitudinally extending joists including a first joist, a last joist, and at least one joist positioned therebetween, adapted to support planar elements defining a ceiling or floor;

a continuous cable acting under tension for generating a compressing force directed substantially only laterally across the joists from said first joist to said last joist; and blocking means acting under compression for opposing the compressing force and keeping the joists spaced apart in static equilibrium.

9. A load carrying structure as recited in claim 8, wherein the cable is attached at one end to the last joist and a spring attached at one end to the first joist, wherein the free ends of the cable and spring are attached to each other.

10. A load carrying structure as recited in claim 8, wherein the blocking means comprises a plurality of blocking elements spanning adjacent joists.

11. A load carrying structure as recited in claim 10, wherein the blocking elements are arranged in two parallel rows that straddle the cable.

12. A load carrying structure as recited in claim 10, wherein the cable passes through the midpoint of each joist.

13. A load carrying structure as recited in claim 10, wherein the cable passes through a first side of the first joist and couples to an opposite side of the first joist, the cable applying the compressive force to the opposite side, further comprising:

a plate coupling the cable to the opposite side of the first joist, wherein the plate overlies a blocking element area; and a spring connected to the cable and selected to have a force that is less than a crushing capacity associated with the joists and the blocking elements multiplied by an area of the plate that overlaps the blocking element area.

14. A prestressed floor structure comprising:

a plurality of substantially parallel, longitudinally extending joist members defining a generally rectangular flooring area, a first outside joist member comprising one side of the area and a last outside joist member comprising an opposite second side of the area, with a plurality of said joist members positioned in between the first and last joists;

a coil spring anchored to the first joist member;

a cable that is passed through each joist member except for the first and last outside members and that is anchored at one end to the last outside joist member and anchored at its other end to the coil spring, the cable having a length such that the spring is stretched; and a plurality of blocking elements placed between adjacent joist members, extending substantially parallel to the cable.

15. A prestressed floor structure as recited in claim 14, wherein the cable passes through the midpoint of the joists.

16. A prestressed floor structure as recited in claim 14, wherein the blocking elements are arranged into two parallel rows that straddle the cable.

17. A prestress floor structure as recited in claim 14, wherein the spring force of the coil spring is selected to create a force on the joist members equal to a predetermined amount that is sufficient to maintain the relative spacing of the joist members while they are subjected to a vertical load.

18. A prestressed floor structure as recited in claim 14, wherein:

the cable passes through the midpoint of the joists;

the blocking elements are arranged into parallel rows that straddle the cable; and the spring force is transmitted through the blocking elements by a compressive force from the cable and spring.

19. A prestressed floor structure as recited in claim 14, wherein the joists are of a laminate construction.

* * * * *

UNITED STATES PATENT AND TRADEMARK OFFICE

CERTIFICATE OF CORRECTION

PATENT NO. : 5,168,681

DATED : December 8, 1992

INVENTOR(S) : Ruben Ayrapetyan

It is certified that error appears in the above-identified patent and that said Letters Patent is hereby corrected as shown below:

Title page, item (73): Please change "Assignee: Horsel PLC, Morley, United Kingdom" to -- Assignee: University of Southern California --

Title page, item (75): Please change "Merchant, Gould, Smith, Edell, Welter & Schmidt" to -- Pretty, Schroeder, Brueggemann & Clark --

Col. 7, line 67: Please change "a load" to -- A load --

Col. 9, line 10: Please change "A prestress" to -- A prestressed --

Signed and Sealed this

Nineteenth Day of July, 1994

Bruce Lehman

*Attest:*

BRUCE LEHMAN

*Attesting Officer*

*Commissioner of Patents and Trademarks*